US005115745A

United States Patent [19]

Ellens et al.

[11] Patent Number: 5,115,745

[45] Date of Patent: May 26, 1992

[54] POWER TRANSMITTING ASSEMBLY FOR RECIPROCATABLY MOVING A SHUTTLE CART

[75] Inventors: Daniel S. Ellens, Brighton; Robert H. Kubsik, West Bloomfield, both of Mich.

[73] Assignee: Jervis B. Webb Company, Farmington Hills, Mich.

[21] Appl. No.: 659,169

[22] Filed: Feb. 22, 1991

[51] Int. Cl.[5] ..... B61M 13/00; B61B 3/00

[52] U.S. Cl. ..... 104/162; 104/96; 104/172.3; 104/173.1; 198/748

[58] Field of Search ..... 104/48, 88, 102, 162, 104/173.1, 172.3, 169, 178, 96, 50; 198/748, 833

[56] References Cited

U.S. PATENT DOCUMENTS 404,656 6/1889 Ramsay ..... 104/50
2,621,609 12/1952 McCaul et al. ..... 104/172.5
3,518,946 7/1970 Kavieff ..... 104/172.3
4,616,570 10/1986 Dehne ..... 104/88

*Primary Examiner*—Robert J. Oberleitner
*Assistant Examiner*—Kevin D. Rutherford
*Attorney, Agent, or Firm*—Joseph W. Farley

[57] ABSTRACT

An article transporting wheeled cart is reciprocatably moved along a pair of transversely spaced rails by a power transmitting unit detachably mounted between and below the rails and comprising a pair of trolley tracks secured to the upstanding legs of transversely extending longitudinally spaced U-shaped track yokes which have base portions located below the tracks and attached to a fluid pressure cylinder unit longitudinally coextensive with the tracks. A trolley, having a pair of oppositely acting driving dogs engageable with the cart, is supported on the tracks and is connected to a motion transmitter reciprocatably driven by the cylinder unit.

12 Claims, 5 Drawing Sheets

POWER TRANSMITTING ASSEMBLY FOR RECIPROCATABLY MOVING A SHUTTLE CART

SUMMARY OF THE INVENTION

This invention relates to improvements in a power transmitting assembly for reciprocatably moving a wheeled, article transporting shuttle cart along transversely spaced rails extending longitudinally between first and second positions.

The power transmitting assembly of the invention, as herein disclosed, is particularly adapted to move a shuttle cart of the type employed in a reelroom to transport a roll of newsprint paper from a receiving station to a transfer table which in turn is movable perpendicularly to the shuttle cart rails for positioning the paper roll in a reelstand of a printing press. In this environment, the shuttle cart rails are conventionally mounted at the level of the reelroom floor. Prior mechanism for reciprocatably moving the shuttle cart has been encased by a box-like frame embedded in the reelroom floor between the shuttle cart rails. As a result, the mechanism has been relatively difficult to properly install, and is relatively inaccessible for service and maintenance requirements. The present invention provides a solution to these problems and other advantages, as will be described.

In the present invention, the power transmitting assembly comprises a pair of parallel longitudinally extending trolley tracks having a length corresponding to the distance between the first and second positions of movement of the shuttle cart. These trolley tracks are connected to and supported by a plurality of longitudinally spaced track yokes. Each of the track yokes extends transversely of the pair of trolley tracks in perpendicular relation therewith; has a pair of transversely spaced legs to which the pair of trolley tracks is secured in a transverse spacing; has a base portion connecting the pair of legs below the pair of trolley tracks; and has a transverse dimension less than the distance between the pair of shuttle cart rails. A trolley, having wheels engaging the pair of trolley tracks, has driving means projecting between and above the pair of trolley tracks to engage a driving member on the shuttle cart. A motive unit, such as a fluid pressure operated cylinder substantially coextensive with the pair of trolley tracks, is supported by cradles on the base portions of the track yokes below the pair of trolley tracks in centered relation therewith, and is attached to at least two longitudinally spaced track yokes. A motion transmitting member reciprocatably driven by the motive unit is suitably connected to the trolley.

Preferably, the pair of trolley tracks is a pair of channel section track members having vertically extending base portions secured to the pair of legs of each of the track yokes and having facing pairs of upper and lower horizontal flanges extending from the base portions to form transversely spaced track surfaces engageable by the wheels of the trolley. The driving means of the trolley comprises a pair of oppositely acting driving dogs pivotally carried thereby, these driving dogs projecting above the upper horizontal track flanges so that the driving member on the shuttle cart is adapted to be engaged by and trapped between the driving dogs.

The pair of trolley tracks has first and second end portions corresponding respectively to the first and second positions of the shuttle cart, the pair of trolley tracks extend horizontally on the first end portion and from that portion to the second end portion. The second end portion is inclined downwardly from horizontal, is adapted t receive the trolley and to position its driving dogs in non-engageable relation with the driven member on the shuttle cart. The connection of the motion transmitting member to the trolley permits relative vertical movement between them on the second end portion of the pair of trolley tracks.

This power transmitting assembly is adapted to be detachably installed in a trench formed in the reelroom floor between the shuttle cart rails, the trench having a bottom wall, a pair of vertical side walls and open ends adjacent to the first and second shuttle cart positions. First and second end track yokes at the first and second end portions of the trolley tracks are detachably connectable to anchoring attachments provided in the trench bottom wall. In this installation, a pair of plates coextensive with the pair of trolley track members is secured to the upper horizontal flanges thereof, these plates being transversely spaced by a longitudinal slot through which the trolley driving dogs project along the horizontally extending portion of the trolley tracks, these plates also forming a continuation of the reelroom floor over the trench and overlapping the vertical trench sidewalls. The power track assembly is easily installable and removable as unit for major maintenance, repair or replacement.

The foregoing, together with other features and advantages of the invention, are further described below with respect to the presently preferred embodiment shown in the accompanying drawings.

DETAILED DESCRIPTION

Figure 1:
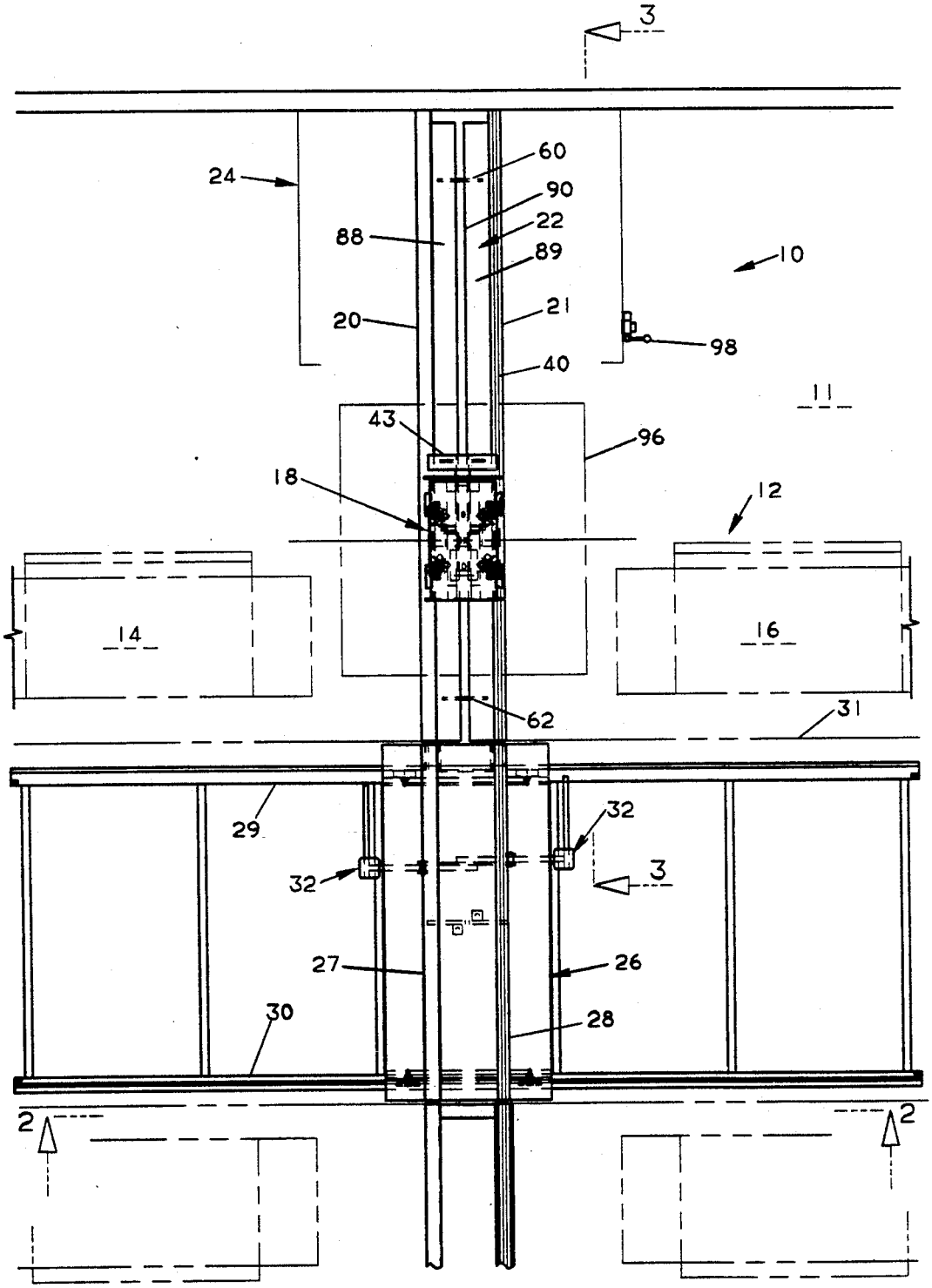
FIG. 1 is a plan view showing a typical installation of the power transmitting assembly of the invention for reciprocatably moving a newsprint paper roll carrying shuttle cart from a roll receiving station to a transfer table of the reelstand.
Figure 2:
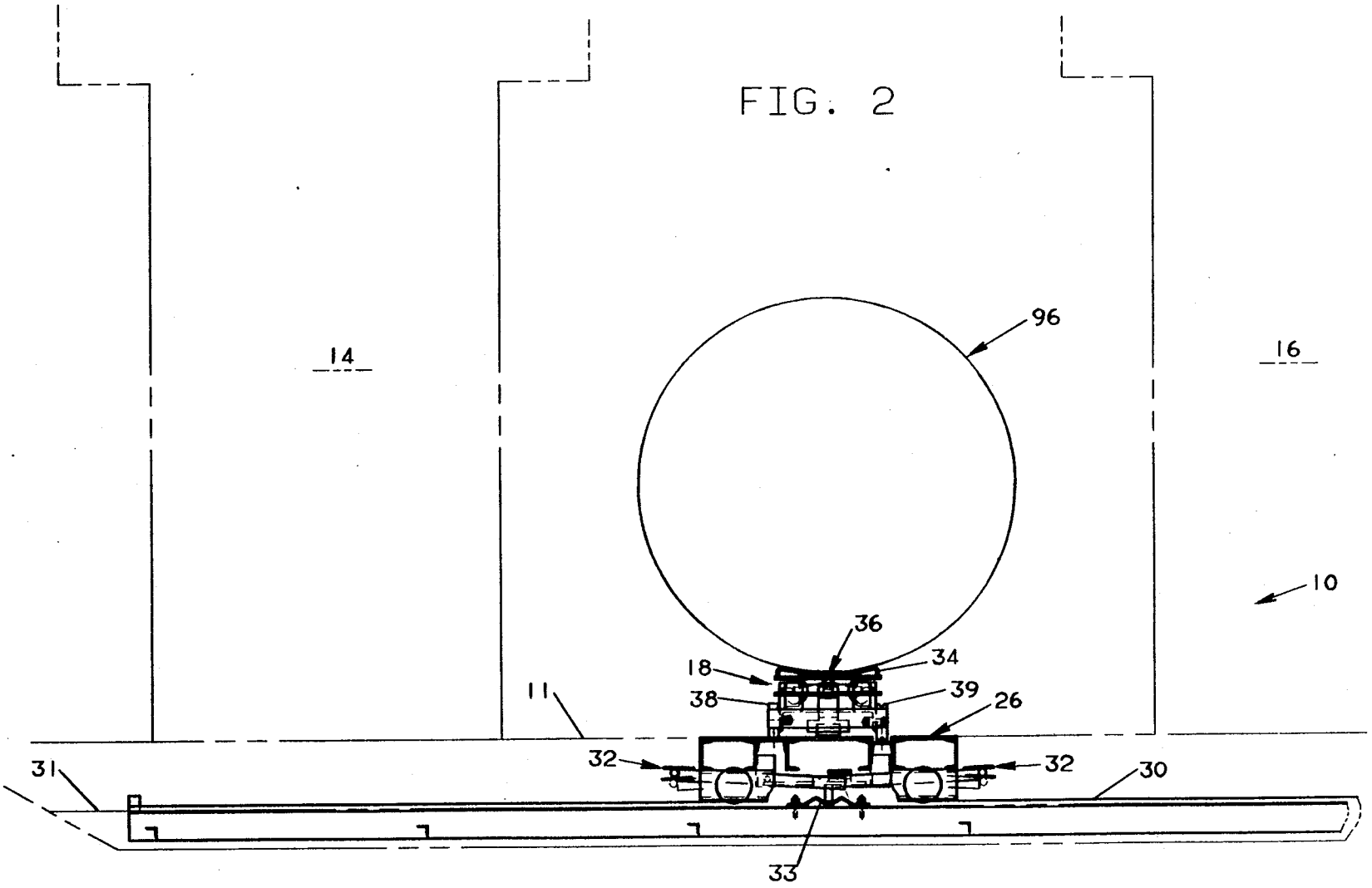
FIG. 2 is a transverse elevation, taken as indicated by the line 2—2 of FIG. 1, showing the shuttle cart, the transfer table, and fragmentary portions of the reelstand.
Figure 3:
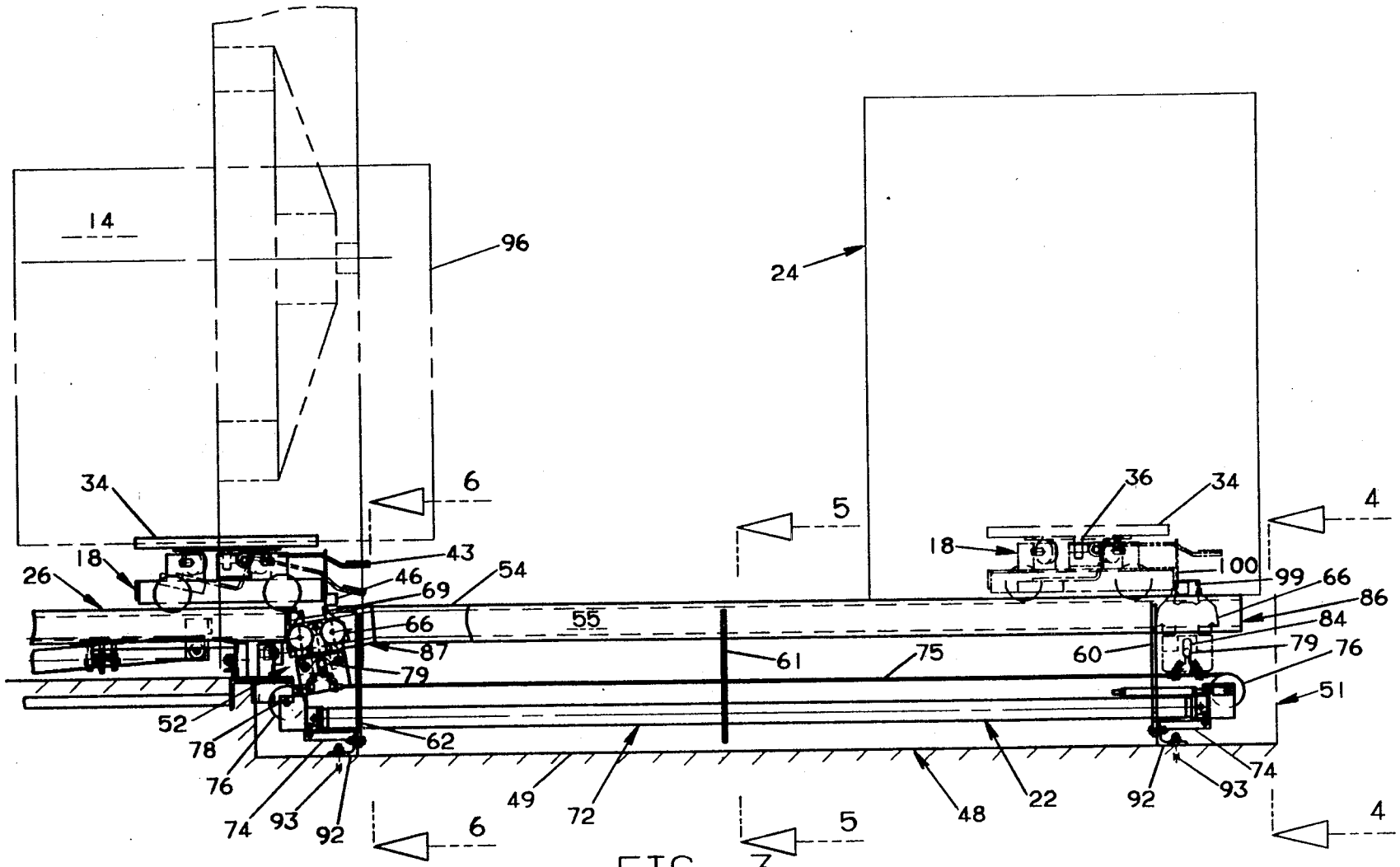
FIG. 3 is a longitudinal sectional elevation, taken substantially as indicated by the line 3—3 of FIG. 1, showing the power transmitting assembly on a larger scale with certain parts broken away for clarity.

FIGS. 1-3 illustrate a portion of a reelroom 10 having a floor 11 and a reelstand 12 formed by a pair of horizontally spaced presses 14 and 16 fragmentarily and schematically shown in broken line. A shuttle cart 18 is reciprocatably movable along a pair of transversely spaced rails 20 and 21, installed on the floor 11, by the power transmitting assembly 22 of the present invention, mounted between and below these rails, between a first position at a receiving station 24 and a second position at a wheeled transfer table 26 (FIG. 3).

The transfer table is provided with a pair of rails 27 and 28 adapted to form extensions of the rails 20 and 21 and is movable on transversely extending rails 29 and 30 in either direction from the centered position shown in FIGS. 1 and 2 to and from either of the presses 14 and 16, the rails 29 and 30 being mounted in a pit 31 below the floor 11 as shown in FIGS. 2 and 3. A foot pedal operated latch mechanism 32 on the transfer table 26 engages a keeper 33 on the surface of the pit 31 to locate the transfer table in the centered position.

Figure 6:
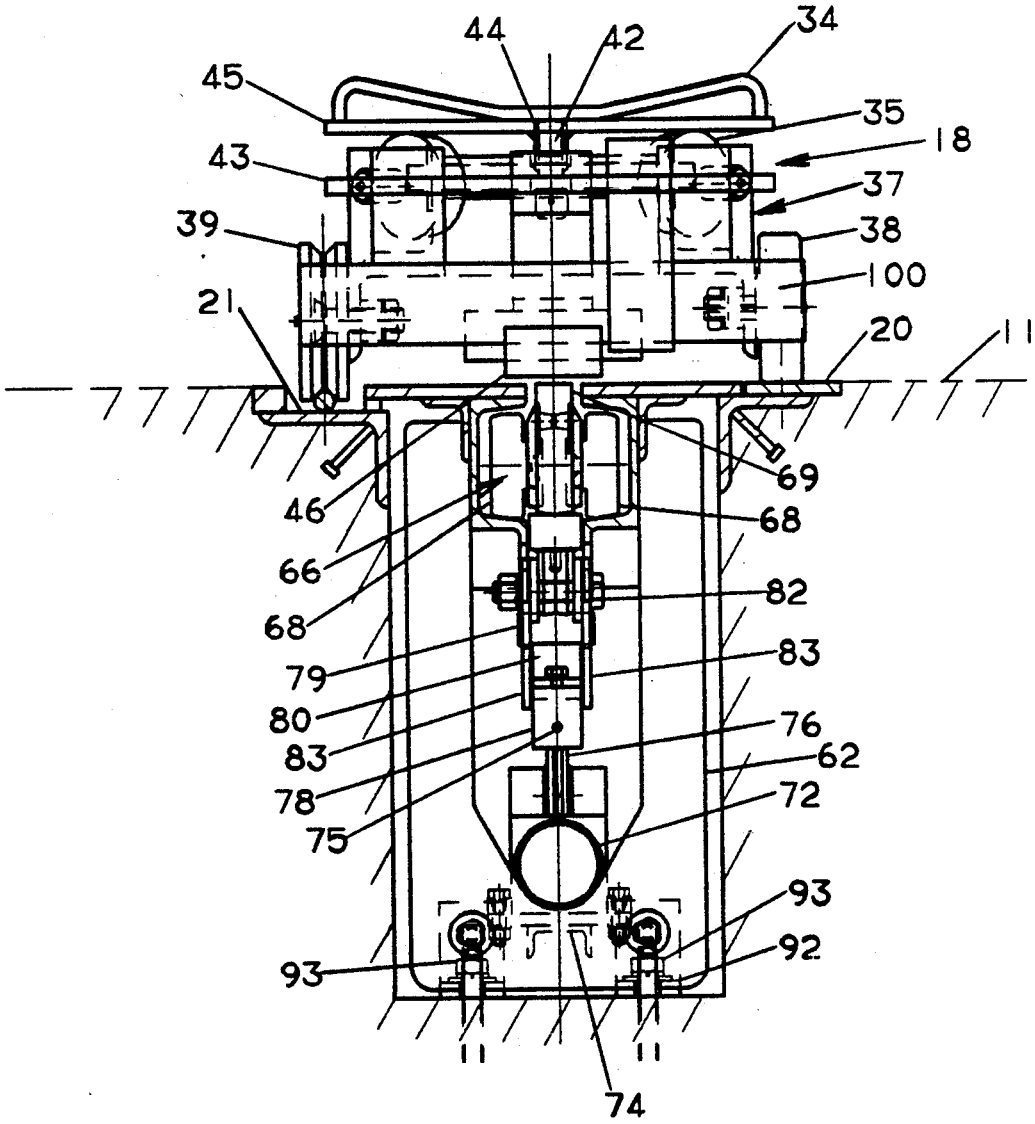

The shuttle cart 18, as best shown in FIGS. 3 and 6 has an upwardly facing article carrying table 34 supported on rollers 35 for rotation on a vertical pivot 36 carried by a base frame 37 having pairs of wheels 38 and 39 engaging the rails 20 and 21 respectively, the wheels 39 being grooved to fit a guide strip 40 on the rail 21. A latchpin 42 (FIG. 6), operable by a pivotal foot pedal 43, is normally urged into engagement with one of two diametrically spaced recesses 44 in a base 45 of the table 34. A driving member 46 depends from one end of the base frame 37 and is engageable by the power transmitting assembly 22, described below, which is mounted in a trench 48 formed in the floor 11 between the rails 20 and 21, the trench 48 having a bottom wall 49, a pair of vertical side walls 50, and substantially open first and second ends 51 and 52.

Referring to FIGS. 3–6, the power transmitting assembly 22 comprises a pair of trolley tracks 54 and 55 having a length substantially corresponding to the distance between the first and second positions of movement of the shuttle cart 18. Preferably, these trolley tracks are channel section track members, as shown, having vertically extending base portions 56 and facing pairs of upper and lower horizontal flanges 57 and 58 which form track surfaces. A plurality of track yokes 60, 61 and 62 are spaced longitudinally of the trolley tracks 54 and 55 and include a first end track yoke 60 and a second end track yoke 62. Each of the track yokes extends transversely of the pair of trolley tracks 54 and 55; has a pair of transversely spaced legs 64 to which the base portions 56 of the trolley tracks are secured, establishing a transverse spacing between the tracks 54 and 55; and, has a base portion 65 connecting the pair of legs 64 below the trolley tracks. Each of the track yokes has a transverse dimension less than the distance between the pair of rails 20 and 21 and the distance between the trench side walls 50.

A trolley 66, having pairs of wheels 68 engageable with the track surfaces 57 and 58 of the pair of trolley tracks 54 and 55, is provided with a pair of longitudinally spaced oppositely acting driving dogs 69 which are pivotally carried by the trolley 66 for movement toward each other, which project above the upper horizontal track flanges 57, and which are adapted to engage the shuttle cart driving member 46 and trap it between them.

A fluid pressure operable cylinder unit 72 substantially coextensive with the pair of trolley tracks 54 and 55 is supported below the pair of trolley tracks 54 and 55 in centered relation therewith by cradles 73 on the base portions 65 of the track yokes 60–62. The cylinder unit 72 is attached to each of the two end track yokes 60 and 62 by a suitable bracket 74. This cylinder unit as shown is a commercially available type having a rodless piston connected to a cable 75 which extends from the ends of the unit and is trained about a pair of pulleys 76. Secured between fittings on the ends of the cable 75 as best shown at the left side of FIG. 3, is a motion transmitter 78 which is transversely U-shaped and carries a cross pin 79 on a pedestal 80 (FIG. 6).

Attached to the trolley 66 by bolts 82 is a pair of plates 83 provided with vertical slots 84 through which the cross pin 79 extends to connect the motion transmitter 78 to the trolley.

As shown in FIG. 3 the pair of trolley tracks 54 and 55 has first and second end portions 86 and 87 which correspond respectively to the first and second positions of the shuttle cart 18, The trolley tracks extend horizontally on and from the first end portion 86 to the second end portion 87 which is formed by a downwardly inclined track section adapted to receive the trolley 66 and position its driving dogs 69 in non-engageable relation with the driving member 46 on the shuttle cart 18. Relative vertical movement between the motion transmitter 78 and the trolley 66 is permitted on this downwardly inclined end portion 87 of the trolley tracks by the slotted connection of the cross pin 79 to the trolley attachment plates 83, described above.

Figure 4:
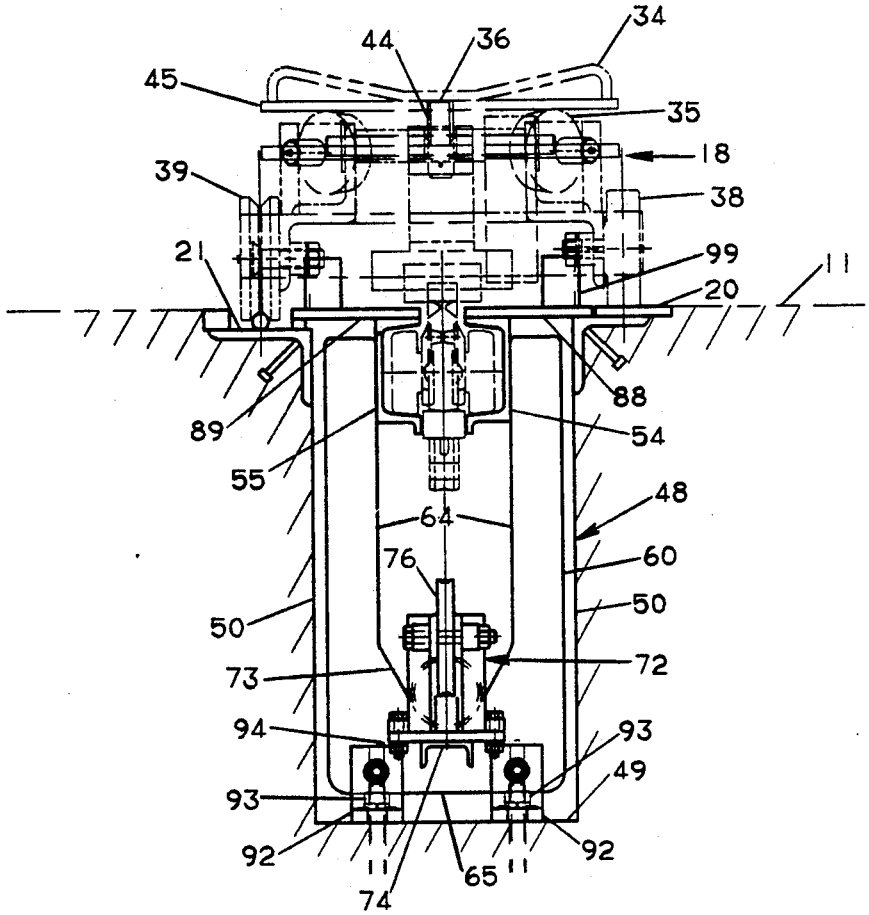
FIGS. 4, 5 and 6 are enlarged transverse sectional elevations taken respectively as indicated by the lines 4—4, 5—5 and 6—6 of FIG. 3.
Figure 5:
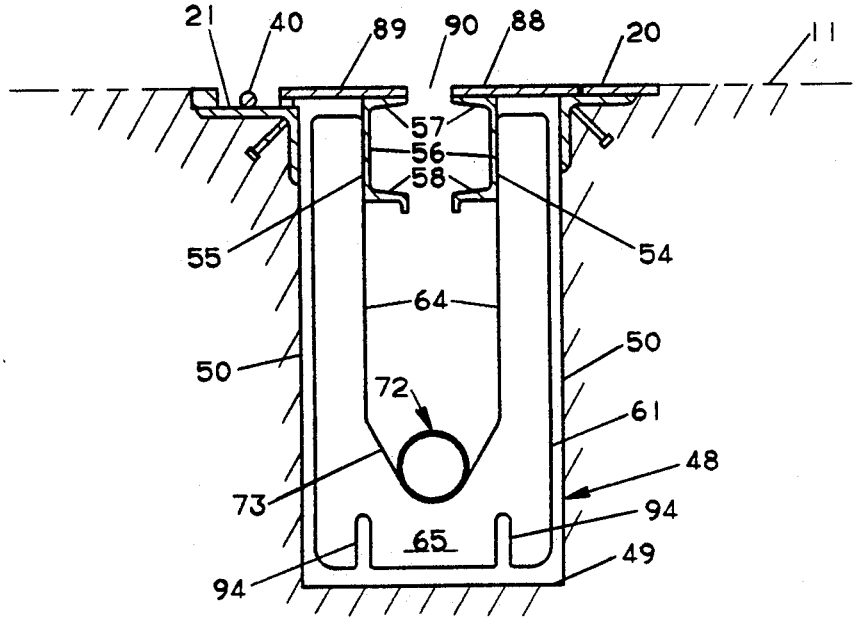

The power transmitting assembly 22 is completed by a pair of plates 88 and 89 secured to the upper horizontal flanges 57 of the pair of trolley tracks 54 and 55. These plates are coextensive with the trolley tracks (but are broken away in FIG. 3 above the end portion 87 of the trolley tracks for clarity); are transversely spaced by a longitudinal slot 90 through which the trolley driving dogs 69 project along the horizontally extending portion of the trolley tracks; and project laterally of the assembly 22 so as to overlap the vertical side walls 50 of the trench 48 and to form a continuation of the floor 11 between the shuttle cart rails 20 and 21 over the top of the trench, as shown in FIGS. 4–6. The plate 89 engages a shim strip 91 on the rail 21.

Thus the power transmitting assembly 22 is a unitary structure which can be placed in the trench 48 and detachably connected to anchoring brackets 92 installed on the trench bottom wall 49. Anchor bolts 93 inserted through the brackets 92 engage open ended slots 94 in the first and second end track yokes 60 and 62, as shown in FIGS. 3, 4 and 6.

In the overall operation of the apparatus described above, a roll of newsprint paper 96 is placed by suitable equipment (not shown) on the article carrying table 34 of the shuttle cart 18 located in its first position at the receiving station 24. When this paper roll 96 is needed at one of the presses 14 or 16 of the reelstand, the power transmitting assembly 22 is activated by the reelstand operator, as by operation of a control valve 98 (FIG. 1), causing fluid pressure to be applied to the left-hand end (FIG. 3) of the cylinder unit 52 through suitable piping (not shown). The shuttle cart driving member 46 is engaged by a driving dog 69 of the trolley 66 and the shuttle cart 18 is first moved to approximately the position shown in FIG. 1, is stopped, and the direction of wrap of the paper roll 96 is checked by the operator.

Should the direction of wrap be wrong for the particular press needing the roll 96, the operator steps on the shuttle cart foot pedal 43, disengaging the latchpin 42, and rotates the roll 96 and shuttle cart table 34 about the pivot 36 on the rollers 35. During the rotation, the operator releases the foot pedal 43 so that the latchpin 42 engages the opposite recess 44 in the shuttle cart table base 45 after 180 degrees of rotation.

With the transfer table 26 locked in the centered position shown in FIG. 1 by the latch mechanism 32 and keeper 33, the operator again actuates the control valve 98 and the shuttle cart 18 is advanced by the power transmitting assembly 22 on to the rails 27 and 28 of the transfer table 26 to approximately the position shown in full line at the left-hand side of FIG. 3. In this position, the trolley driving dogs 69 are disengaged from the shuttle cart driving member 46 and are retracted below the floor plates 88 and 89 out of the operator's way. The operator then pushes the shuttle cart 18 into a centered position of the paper roll 96 on the transfer table 26, disengages the transfer table latch mechanism 32, and pushes the transfer table on the rails 29 and 30 to the proper press 14 or 16.

After the paper roll has been placed on the spindles of the press, the operator returns the transfer table 26 to its centered, latched position, pushes the empty shuttle cart onto the rails 20 and 21, and actuates the control valve 98 to cause the power transmitting assembly 22 to drive the shuttle cart 18 back to its first position in the receiving station 24, which position may be defined by stops 99 on the plates 80 and 89 engaged by a bumper 100 on the shuttle cart (FIGS. 3 and 4).

Routine service and maintenance on the components of the power transmitting assembly 22, as required during its operation, can be performed from the open ends 51 and 52 of the trench 48. It can be seen from FIG. 3 that the trolley 66 is readily accessible, particularly from the trench end 51, for removal and replacement, if necessary. Likewise, the connecting brackets 74 of the cylinder unit 72 are accessible from the trench ends 51 and 52, permitting the removal and replacement of this unit. In case a major repair is required, the entire assembly 22 can be removed from the trench 48, simply by loosening the four anchor bolts 93, and replaced by another assembly 22. Such servicing, maintenance and replacement can readily be performed between press runs, which is very important in the overall operation of a reelroom.

We claim:

1. A power transmitting assembly for reciprocatably moving an article transporting wheeled shuttle cart along a pair of longitudinally extending transversely spaced rails between first and second positions, said power transmitting assembly being adapted to be detachably installed as a unit between and below said rails and comprising:

a pair of parallel longitudinally extending trolley tracks having a length corresponding to the distance between said first and second positions;

a plurality of track yokes spaced longitudinally of said pair of trolley tracks, each of said track yokes extending transversely of said pair of trolley tracks in perpendicular relation therewith, each of said track yokes having a pair of transversely spaced legs to which said pair of trolley tracks is secured in a transverse spacing, and having a base portion connecting said pair of legs below said pair of trolley tracks, the transverse dimension of each of said track yokes being less than the maximum transverse spacing between said pair of rails;

a trolley having wheels engaging said pair of trolley tracks and having shuttle cart driving means projecting between and above said pair of trolley tracks, said driving means being reversibly engageable with said shuttle cart;

a fluid pressure operable cylinder unit substantially coextensive with said pair of trolley tracks, cradle means on the said base portion of said track yokes for supporting said cylinder unit below said pair of trolley tracks in centered relation therewith, and means for attaching said cylinder unit to at least two of said longitudinally spaced track yokes; and motion transmitting means reciprocatably driven by said cylinder unit and attachment means for connecting said motion transmitting means to said trolley.

2. A power transmitting assembly according to claim 1 wherein said pair of trolley tracks comprise a pair of channel section track members having a pair of vertically extending base portions secured to the pair of legs of each of said track yokes and having facing pairs of transversely spaced upper and lower horizontal flanges extending from said base portions, said horizontal flanges forming transversely spaced track surfaces engageable by said trolley wheels, said driving means comprising a pair of longitudinally spaced oppositely acting driving dogs pivotally carried by said trolley for movement towards each other, said driving dogs projecting above said upper horizontal track flanges, and a driven member on said shuttle cart adapted to be engaged and trapped between said driving dogs.

3. A power transmitting assembly according to claim 2 wherein said pair of trolley tracks has first and second end portions corresponding respectively to said first and second shuttle cart positions, said pair of trolley tracks extending horizontally on said first end portion and from said first end portion to said second end portion, said second end portion being formed by a track section which is inclined downwardly from horizontal and which is adapted to receive said trolley and position said driving dogs in non-engageable relation with said driven member on said shuttle cart.

4. A power transmitting assembly according to claim 3 wherein said attachment means includes a connection which permits relative vertical movement between said motion transmitting means and said trolley along said second end portion of said pair of trolley tracks.

5. A power transmitting assembly according to claim 4 further comprising a pair of plates secured to the upper horizontal flanges of said pair of track members, said pair of plates being coextensive with said pair of track members and being transversely spaced by a longitudinal slot, and said driving dogs projecting through and above said slot along the horizontally extending portion of said trolley tracks.

6. A power transmitting assembly according to claim 5 wherein said pair of longitudinally extending transversely spaced rails is mounted on a supporting surface, a trench formed in said supporting surface between said rails for receiving said power transmitting assembly, said pair of plates being adapted to form a continuation of said supporting surface between said rails and over said trench.

7. A power transmitting assembly according to claim 6 wherein said trench is provided with anchoring means to which said power transmitting assembly is detachably connectable.

8. A power transmitting assembly according to claim 7 wherein said trench has a bottom wall, a pair of vertical side walls, and substantially open ends adjacent to said first and second positions, said track yokes including first and second end track yokes at the said first and second end portions of said trolley tracks, said first and second end track yokes being detachably connectable to said anchoring means adjacent to said open ends of said trench.

9. A power transmitting assembly according to claim 8 wherein said pair of plates overlap the said pair of vertical side walls of said trench.

10. A power transmitting assembly according to claim 2 wherein said pair of trolley tracks has an end portion formed by a downwardly inclined section adapted to receive said trolley and to thereby position said driving dogs in non-engageable relation with said driven member on said shuttle cart.

11. A power transmitting assembly according to claim 1 wherein said pair of trolley tracks has first and second end portions corresponding respectively to said first and second shuttle cart positions, said trolley tracks at one of said end portions having a downwardly inclined section adapted to receive said trolley and to position said driving means thereof in non-engaging relation with said shuttle cart.

12. Article transporting apparatus comprising a wheeled shuttle cart having an upwardly facing article carrying table, longitudinally extending transversely spaced supporting and guiding rail means engageable by wheels on the shuttle cart, and a unitary power transmitting assembly for reciprocatably moving the shuttle cart between first and second positions on said rail means, wherein said power transmitting assembly comprises:

a pair of longitudinally extending trolley tracks having first and second ends corresponding respectively to said first and second positions;

means for supporting said pair of trolley tracks in parallel, transversely spaced relation, said trolley track supporting means including first and second track yokes each having a base portion and a pair of transversely spaced legs extending from said base portion, said pair of trolley tracks being connected adjacent the first and second ends thereof to the pair of legs of said first and second track yokes, respectively, each of said first and second track yokes being disposed in substantially perpendicular relation with said pair of trolley tracks and having the said base portion spaced downwardly from said pair of trolley tracks, the maximum transverse dimension of each of said track yokes being less than the transverse spacing of said rail means;

a trolley having wheels engaging said pair of trolley tracks and having driving means reversibly engageable with said shuttle cart;

a motive unit substantially coextensive with said pair of trolley tracks, cradle means on the said base portion of each of said first and second track yokes for positioning said motive unit in parallel, centered spaced relation with said pair of trolley tracks, and means for attaching said motive unit to each of said first and second track yokes;

motion transmitting means reciprocatably driven by said motive unit and connected to said trolley;

and means for detachably mounting said power transmitting assembly between and below said supporting and guiding rail means.

* * * * *